US007806504B2

(12) United States Patent
Taira et al.

(10) Patent No.: US 7,806,504 B2
(45) Date of Patent: Oct. 5, 2010

(54) INK-JET HEAD PROTECTION ASSEMBLY AND PROTECTION METHOD OF AN INK-JET HEAD

(75) Inventors: Hiroshi Taira, Ichinomiya (JP); Yoshirou Kita, Nagoya (JP); Tadanobu Chikamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 756 days.

(21) Appl. No.: 11/692,785

(22) Filed: Mar. 28, 2007

(65) Prior Publication Data

US 2007/0229581 A1 Oct. 4, 2007

(30) Foreign Application Priority Data

Mar. 31, 2006 (JP) ..... 2006-097267

(51) Int. Cl.
*B41J 2/165* (2006.01)

(52) U.S. Cl. ..... 347/29; 347/22; 347/34

(58) Field of Classification Search ..... 347/21, 347/22, 25, 29, 30, 68, 70, 71, 34
See application file for complete search history.

(56) References Cited

U.S. PATENT DOCUMENTS

| | | | |
|---|---|---|---|
| 4,684,963 | A | 8/1987 | Naka |
| 6,074,037 | A | 6/2000 | Nakahara et al. |
| 6,540,322 | B2 * | 4/2003 | Usui et al. ..... 347/29 |
| 2004/0056918 | A1 | 3/2004 | Wang et al. |

FOREIGN PATENT DOCUMENTS

| | | | |
|---|---|---|---|
| JP | S60-260341 | A | 12/1985 |
| JP | H01-148557 | A | 6/1989 |
| JP | H03-030674 | U | 3/1991 |
| JP | H07-089085 | A | 4/1995 |
| JP | H10-193626 | A | 7/1998 |
| JP | H11-102226 | A | 4/1999 |
| JP | 2004-066463 | | 3/2004 |
| JP | 2004-114647 | A | 4/2004 |

OTHER PUBLICATIONS

Japan Patent Office; Notice of Reasons for Rejection in Japanese Patent Application No. 2006-097267 (counterpart to the above-captioned U.S. patent application) mailed Jan. 12, 2010 (abridged translation).

Japan Patent Office; Notice of Reasons for Rejection in Japanese Patent No. 2006-097267 (counterpart to the above-captioned U.S. patent application) mailed Apr. 6, 2010 (abridged translation).

* cited by examiner

*Primary Examiner*—Juanita D Stephens
(74) *Attorney, Agent, or Firm*—Baker Botts L.L.P.

(57) ABSTRACT

An ink-jet head protection assembly of the present invention comprises an ink-jet head, a head cap that protects the ink-jet head and a support member supporting the head cap so that the head cap contacts an ejection face of the ink-jet head. In the head cap, a surface confronting the ejection face of the ink-jet head is formed with a protrusion contacting the ejection face. A contact surface of the protrusion to the ejection face surrounds, in plan view, an area in which ejection ports are formed. Gas is filled in a closed space defined by a surface of the head cap, the protrusion and the ejection face.

10 Claims, 14 Drawing Sheets

INK-JET HEAD PROTECTION ASSEMBLY AND PROTECTION METHOD OF AN INK-JET HEAD

BACKGROUND OF THE INVENTION

1. Field of the Invention

The present invention relates to an ink-jet head protection assembly for protecting nozzles when transporting an ink-jet head and the like, and a protection method of an ink-jet head.

2. Description of Related Art

There is a means for protecting ejection ports when transporting and preserving an ink-jet head of ejecting ink drops from the ejection ports. For example, in a recording head (ink-jet head) disclosed in a Japanese Patent Unexamined Publication No. Hei7-89085, a seal of acryl-based adhesive is closely adhered to an ink ejection port face (ejection face) and a recording head is put in a storage case of conductive polystyrene, which is again put in an aluminum pouch, thereby preserving the recording head.

However, in the recording head disclosed in the above document, since the seal is closely adhered to the ink ejection port face, the adhesive of the seal is transferred to the ink ejection port face and the transferred adhesive blocks the ink ejection ports. As a result, when the ink-jet head is used, there may occur a bad ejection problem of the ink.

SUMMARY OF THE INVENTION

An object of the invention is to provide an ink-jet head protection assembly capable of protecting ejection ports while not causing a bad ejection problem of ink drops when using an ink-jet head and a protection method of an ink-jet head.

According to the invention, there is provided an ink-jet head protection assembly including an ink-jet head, and a head cap, a support member. The ink-jet head includes a passage unit having an ejection face provided with ejection ports to eject ink and an ink passage formed therein to communicate with the ejection ports. The head cap has a confronting surface confronting the ejection face and a protrusion protruding toward the ejection face. The confronting surface include, in plan view, an area of the ejection face in which the ejection ports are formed. The protrusion has a contact surface to the ejection face surrounding, in plan view, the area of the ejection face in which the ejection ports are formed. The support member supporting the head cap so that the contact surface is in contact with the ejection face. Gas is filled in a closed space defined by the confronting surface, the protrusion and the ejection face.

According to the invention, contrary to a case where an ejection face is protected with an adhesive tape, there does not occur a case where as an adhesive remains an ejection face, thereby blocking an ejection port. Therefore, it is possible to protect the ejection face while preventing the bad ejection of ink drops when using an ink-jet head.

In addition, according to another aspect of the invention, there is provided a protection method of an ink-jet head including a passage unit having an ejection face provided with ejection ports to eject ink and ink passages formed therein to communicate with the ejection ports. The method has a valve attaching step, a liquid introducing step, a valve opening step, a filling step, a cap attaching step, and a valve sealing step. The valve attaching step is the step of attaching a valve having first, second and third ink supply ports different from one another to the ink-jet head so that the first ink supply port is connected to the ink passage of the passage unit. The valve selectively takes a communication state in which the second ink supply port communicates with the first ink supply port and does not communicate with the third ink supply port and a sealed state in which the second ink supply port communicates with the third ink supply port and does not communicate with the first ink supply port. The liquid introducing step is the step of introducing liquid into one of the second and third ink supply ports of the valve that is attached to the ink-jet head in the valve attaching step and is made to be under sealed state, and discharging the introduced liquid from the other ink supply port of the second and third ink supply ports. The valve opening step is the step of changing the state of the valve to the communication state from the sealed state after the liquid introducing step. The filling step is the step of filling the liquid in the ink passage of the ink-jet head through the second ink supply port and the first ink supply port of the valve that is made to be under communication state in the valve opening step. The cap attaching step is the step of attaching a head cap, which is provided with a protrusion which have a contact surface to the ejection face and is formed along an imaginary closed curve in plan view, to the ink-jet head filled with the liquid in the filling step so that the contact surface is in contact with the ejection face and surrounds, in plan view, an area in which the ejection ports are formed. The valve sealing step is the step of changing the state of the valve to the sealed state from the communication state in the ink-jet head filled with the liquid in the filling step.

According to the invention, contrary to a case where an ejection face is protected with an adhesive tape, there does not occur a case where as an adhesive remains an ejection face, thereby blocking an ejection port. Therefore, when using the ink-jet head, it is possible to secure an accuracy of ink ejection from the ejection ports while protecting the ejection face, securely. In addition, the liquid such as ink is filled in the ink-jet head through the valve that selectively adopts the two states. Thereby, when transporting or preserving the ink-jet head, it is possible to prevent the foreign substance or air from getting mixed into the ink passages. In addition, before the liquid is filled in the ink-jet head through the valve, the liquid is introduced from one of the second and third ink supply ports and is discharged from the other while the second ink supply port communicating with the third ink supply port and not communicating with the first ink supply port. Accordingly, since the air or foreign substances remaining in the passages from the second ink supply port to the third ink supply port are removed, it is possible to prevent the air or foreign substances from getting mixed into the ink-jet head when introducing the liquid into the ink-jet head. Further, since the ink supply ports connected to the passage unit are blocked while the liquid being filled in the ink passage, it is difficult for the air or foreign substances to intrude from the other ink supply ports or for the liquid in the ink passages to evaporate from the supply ports. In other words, it is possible to securely maintain the state in which the intrusion of the air or foreign substances is suppressed since the liquid is filled in the ink passage.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Hereinafter, preferred embodiments of the present invention will be described with reference to the accompanying drawings.

Figure 1:
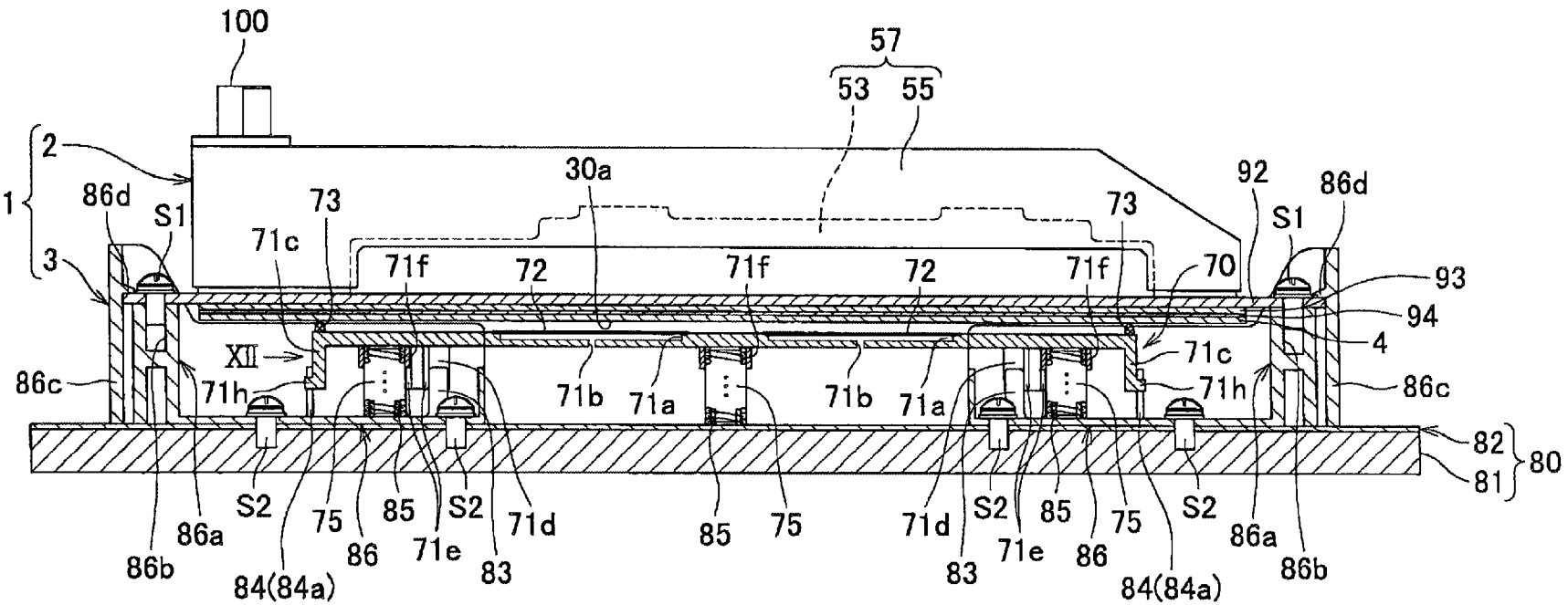
FIG. 1 is a view of schematically showing a structure of an ink-jet head protection assembly according to an embodiment of the invention.
Figure 2:
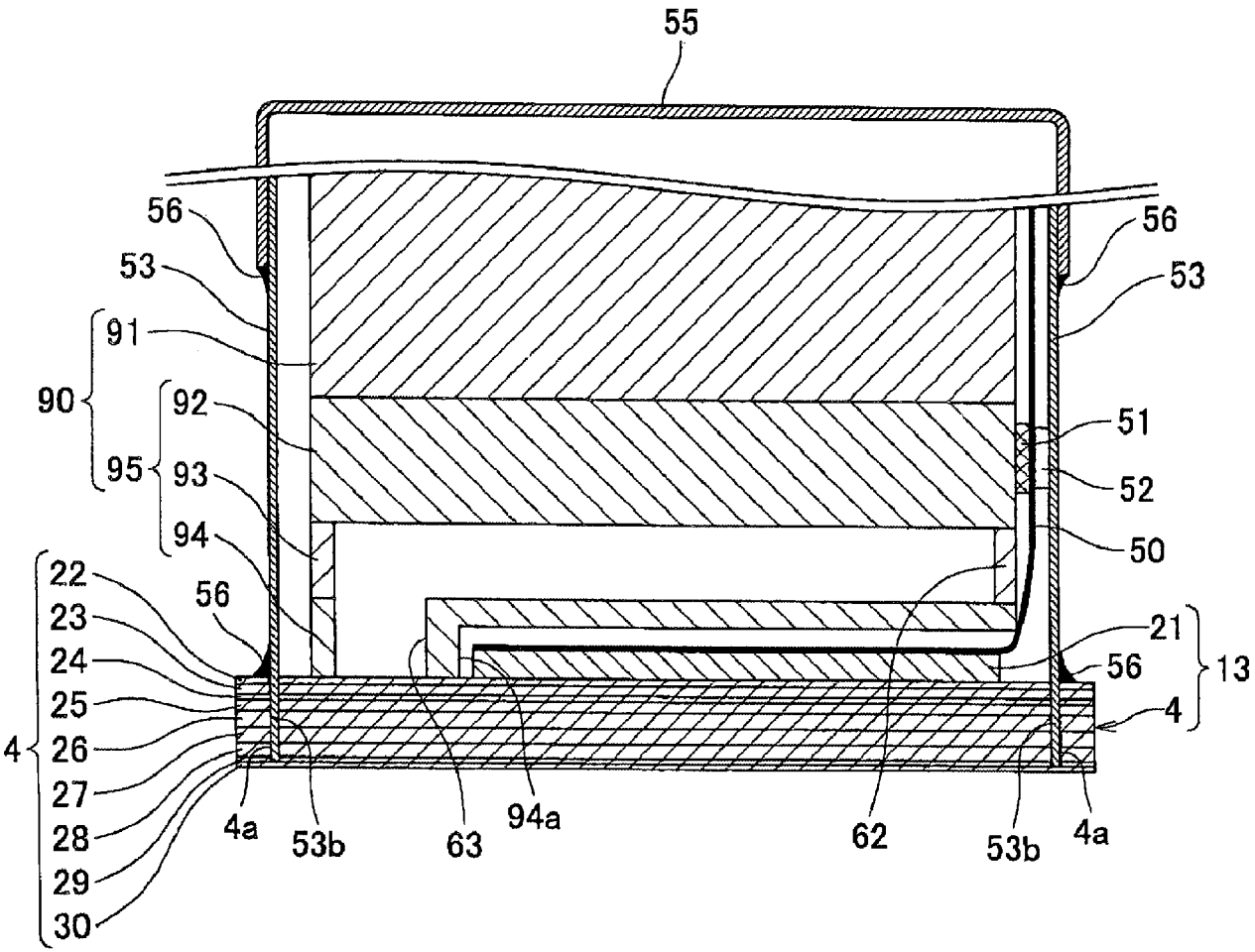
FIG. 2 is a sectional view taken along a lateral direction of an ink-jet head in FIG. 1.

FIG. 1 is a view of schematically showing a structure of an ink-jet head protection assembly according to an embodiment of the invention. FIG. 2 is a sectional view taken along a lateral direction of an ink-jet head in FIG. 1. In FIG. 1, regarding parts above a reservoir base plate 92 which will be described later, only external appearances thereof are depicted and an upper reservoir 91 (refer to FIG. 2) disposed in a head cover 55 and side covers 53 are not depicted.

As shown in FIG. 1, an ink-jet head protection assembly 1 comprises an ink-jet head 2 and an ink-jet head protection unit 3. As described below, the ink-jet head 2 is attached to the ink-jet head protection unit 3, and an ink ejection face 30*a*, which is a bottom surface of the ink-jet head 2, is covered with a head cap 70 constituting the ink-jet head protection unit 3.

The structures of the ink-jet head 2 and the ink-jet head protection unit 3 and the positional relation between the head and the unit in the ink-jet head protection assembly 1 will be specifically described.

FIG. 2 is a sectional view taken along a lateral direction of the ink-jet head 2 in FIG. 1. As shown in FIGS. 1 and 2, the ink-jet head 2 comprises a head main body 13, a reservoir unit 90, a COF (Chip On Film) 50 and a reinforcement cover 57. The head main body 13 comprises a passage unit 4 and piezoelectric actuators 21. The reservoir unit 90 is disposed on an upper surface of the head main body 13 and supplies ink to the head main body 13. A driver IC 52 for driving the piezoelectric actuators 21 is mounted on a surface of the COF 50. The reinforcement cover 57 has side covers 53 and a head cover 55. The side covers 53 cover the piezoelectric actuators 21, the reservoir unit 90 and the COF 50. The side covers 53 are comprised of metal material and are upright mounted on an upper surface of the passage unit 4. The COF 50 is connected to a substrate (not shown). By the substrate, the piezoelectric actuators 21 are driven through the COF 50 and the driver IC 52. A sponge 51 is disposed between the COF 50 and a side face of the reservoir unit 90. The sponge 51 presses the driver IC 52 toward the side cover 53. Thereby, the drive IC 52 and the side cover 53 are thermally coupled to each other.

The reservoir unit 90 consists of a lower reservoir 95 disposed on the upper surface of the passage unit 4 and an upper reservoir 91 disposed on an upper surface of the lower reservoir 95. The lower reservoir 95 has such a structure that three plates of a reservoir base plate 92, a reservoir plate 93 and an under plate 94 are laminated, with being lined up with each other. Ink passages 62, 63 are formed in the lower reservoir 95.

The passage unit 4 has a laminated structure in which a cavity plate 22, a base plate 23, an aperture plate 24, a supply plate 25, manifold plates 26, 27, 28, a cover plate 29 and a nozzle plate 30 are piled up on one another.

The passage unit 4 is formed with grooves 4*a*. The side covers 53 are inserted into the grooves 4*a*. A seal member 56 is applied between the side covers 53 and the passage unit 4. In addition, the seal member 56 is also applied between the side covers 53 and the head cover 55.

Figure 3:
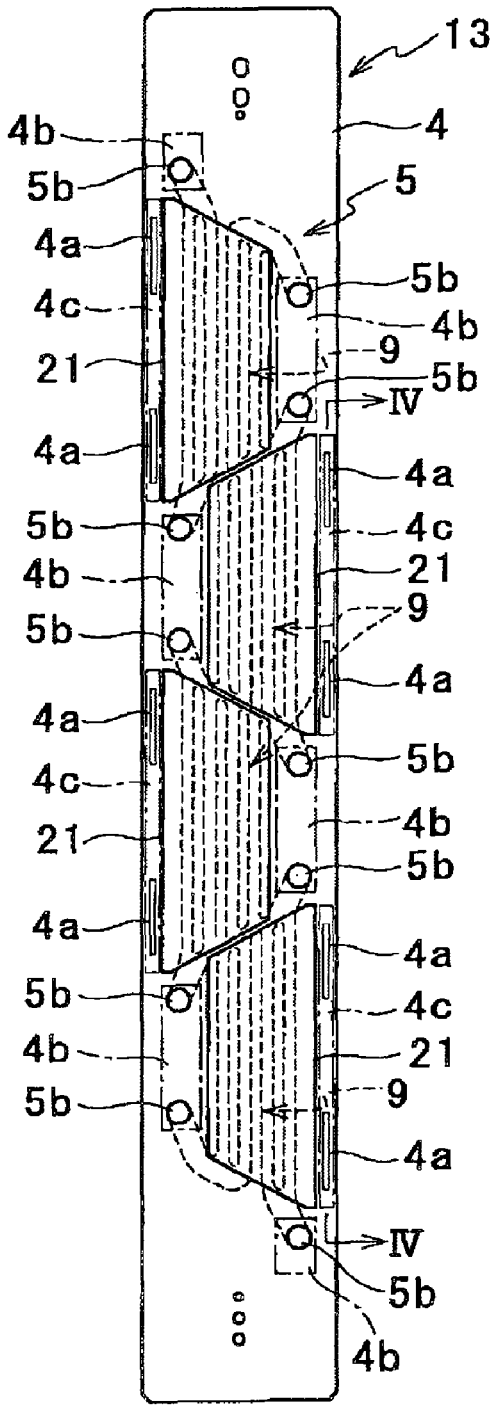
FIG. 3 is a plan view of a head main body in FIG. 2.

FIG. 3 is a plan view of the head main body 13 in FIG. 2. Ink passages are formed in the head main body 12. The ink passages have manifold passages 5 and sub-manifold passages 5*a* that are branched from the manifold passages 5. In FIG. 3, the manifold passages 5 and the sub-manifold passages are depicted by a dotted line and the other ink passages communicating with the passages are not depicted. The head main body 13 has such a structure that the piezoelectric actuators 21 are disposed on an upper surface of the passage unit 4. The passage unit 4 is formed on its upper surface with ink supply ports 5*b* communicating with the manifold passages 5. The ten ink supply ports 5*b* are disposed on six disposal regions 4*b* for an ink supply port which are provided on the upper surface of the passage unit 4. Four pressure chamber groups 9 are formed in the passage unit 4. Each of the pressure chamber groups 9 has a number of pressure chambers 9 which will be described later. In addition, eight grooves 4*a* are formed adjacent to both ends of the passage unit 4.

The reservoir unit 90 is disposed on the upper surface of the head main body 13 while interposing the piezoelectric actuators 21 between the passage unit 4 and it (refer to FIG. 2). The lower surface of the reservoir unit 90 and the upper surface of the head main body 13 are fixed near the disposal regions 4*b* for an ink supply port. The ink passages 63 of the reservoir unit 90 communicate with the ink supply ports 5*b* of the passage unit 4.

Figure 4:
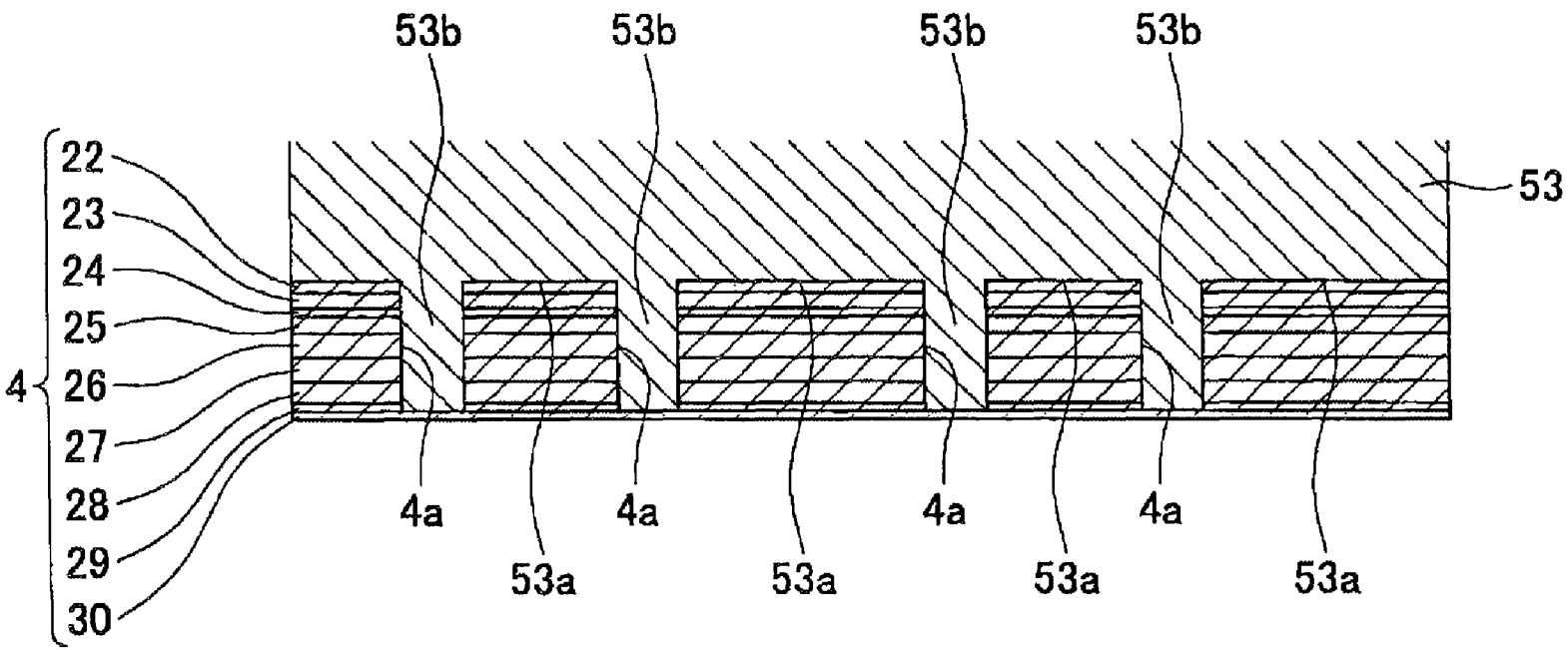
FIG. 4 is a sectional view taken along a line IV-IV in FIG. 3.

FIG. 4 is a sectional view taken along a line IV-IV in FIG. 3. The side covers 53 are provided on the lower ends thereof with a number of protrusions 53*b*. The protrusions 53*b* are respectively fitted into the grooves 4*a* of the passage unit 4. Thereby, the side covers 43 are fixed to the passage unit 4 such that lower ends 53*a* of the side covers 53 are closely contacted to the upper surface of the passage unit 4.

As shown in FIG. 2, the two side covers 53 and the head cover 55 are disposed in the passage unit with regard to the lateral direction of the passage unit 4. In addition, as shown in FIG. 1, the longitudinal lengths of the side covers 53 and the head cover 55 are shorter than the longitudinal length of the reservoir base plate 92, and the covers are disposed in the reservoir base plate 92 with respect to the longitudinal direction of the reservoir unit 90. In other words, an outward profile, viewed from the plane of the reinforcement cover 57 consisting of the side covers 53 and the head cover 55, is involved in an outward profile of the ink-jet head 2. Further, the outward profile of the reinforcement cover 57 involves an outward profile of a lip 73 provided to the head cap 70 which will be described later. Like this, the passage unit 4 is reinforced by the reinforcement cover 57, so that deformations of the passage unit 4 and the reservoir unit 90 are suppressed when the ink ejection face 30*a* is pressed by the head cap 70, as described later. In addition, since the side covers 53 are comprised of metal material and are upright mounted on an upper surface of the passage unit 4, the passage unit 4 is sufficiently reinforced even when the side covers 53 are thin plates.

Figure 5:
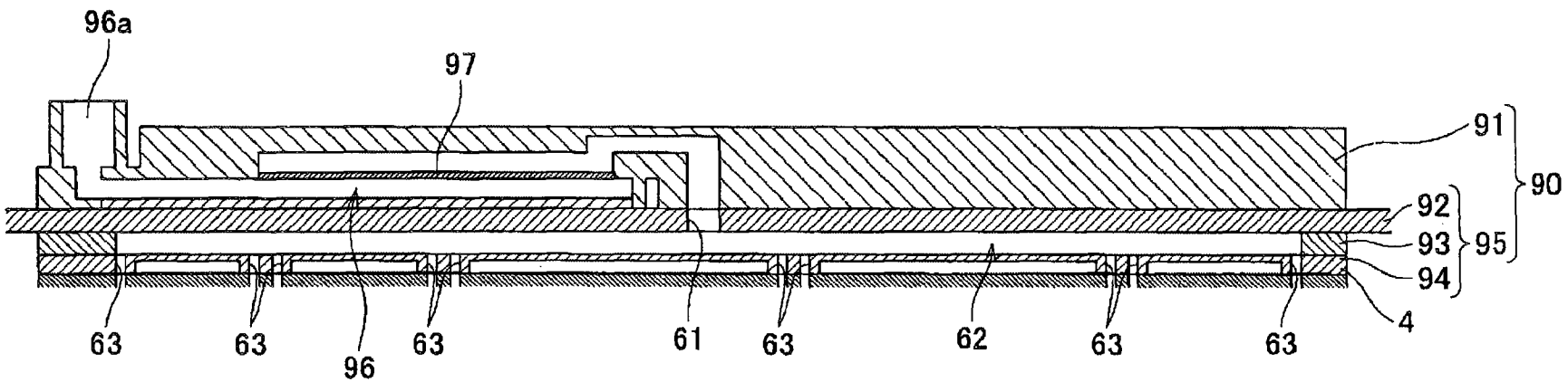
FIG. 5 is a sectional view taken along a longitudinal direction of a reservoir unit in FIG. 2.

The ink passages formed in the reservoir unit 90 are more specifically described with reference to FIG. 5. FIG. 5 is a longitudinally sectional view of the reservoir unit 90 in FIG. 2. The reservoir base plate 92 is formed with a through-hole 61. The reservoir plate 93 is formed with an ink passage 62. The under plate 94 is formed with through-holes 63 at positions corresponding to the respective ink supply ports 5*b* in plan view. The upper reservoir 91 is formed with an ink passage 96 and an ink supply part 96*a*. In the reservoir unit 90, the ink supply part 96*a*, the through-hole 61, the ink passage 62 and the through-holes 63 communicate with one another, so that an ink passage is formed from the ink supply part 96*a* to the through-holes 63. On the other hand, as shown in FIG. 1, a valve 100 is attached to the ink supply part 96*a*. The valve 100 is supplied with liquid, such as ink, preservation solution and the like, from the outside. Thereby, the liquid supplied to the valve 100 is distributed to each of the ink supply ports 5*b* of the passage unit 5 via the ink passages in the reservoir 90. In the mean time, a filter 97 is provided on the way of the ink passage 96. The foreign substances in the liquid supplied from the ink supply part 96*a* are removed by the filter 97 before they reach the ink supply ports 5*b*.

Figure 6:
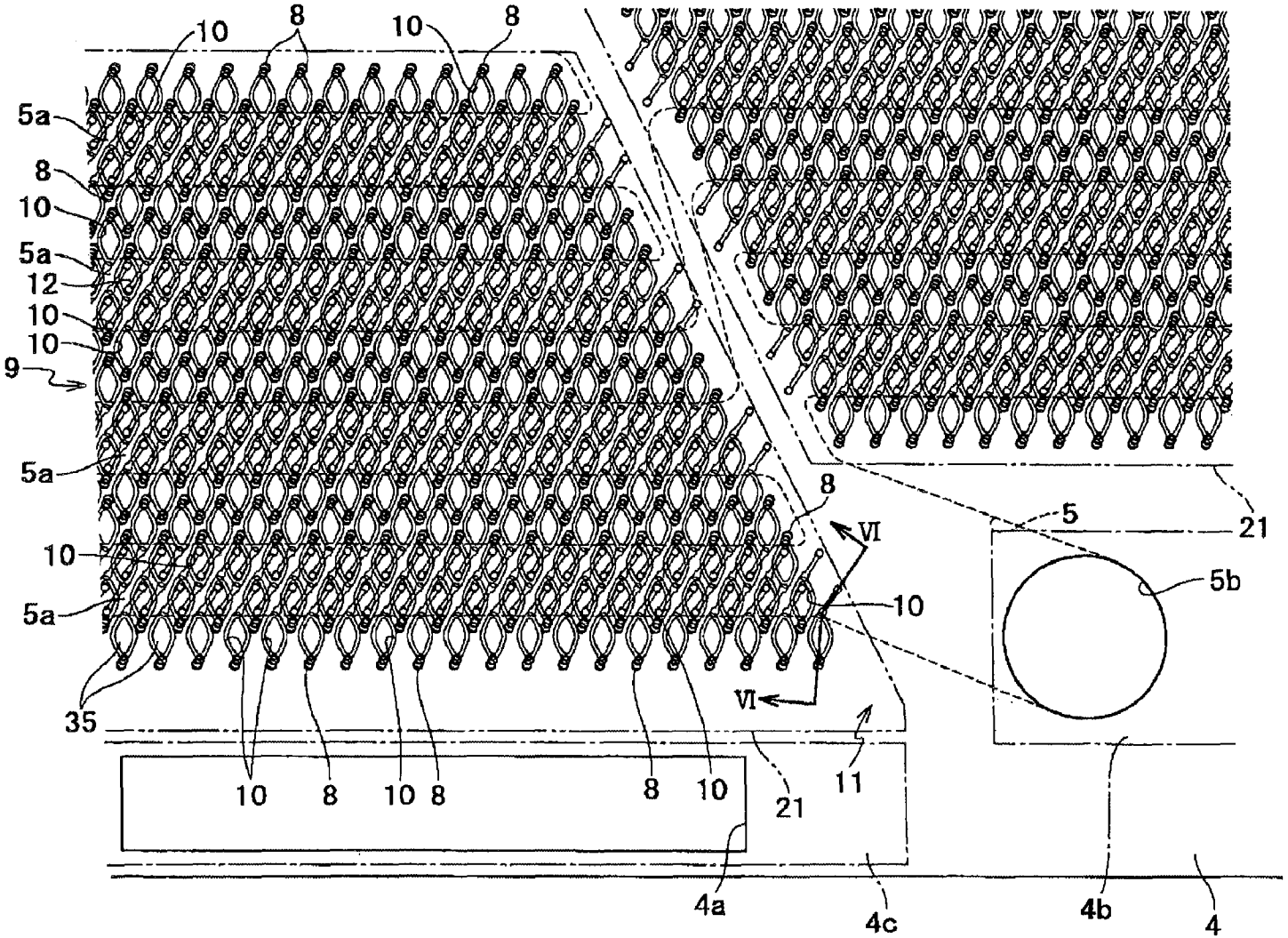
FIG. 6 is a partially enlarged view of FIG. 3.

In the followings, the head main body 13 is more specifically described with reference to FIG. 6. FIG. 6 is a partially enlarged view of FIG. 3. On the lower surface of the passage unit 4, areas confronting the adhesion areas of the piezoelectric actuators 21 are ink ejection areas. On surfaces of the ink ejection areas, a number of nozzles 8 are regularly arranged. The nozzles 8 communicate with the sub-manifold passages 5*a* through restriction passages 12. On the upper surface of the passage unit 4*e* a number of pressure chambers 9 are arranged in a matrix pattern. A single pressure chamber group 9 consists of a number of pressure chambers 9 present in the area confronting the adhesion area of the single piezoelectric actuator 21. Each of the piezoelectric actuators 21 is formed with a number of individual electrodes 35, as described below. Each of the pressure chambers 35 confronts each of the individual electrodes 35.

Figure 7:
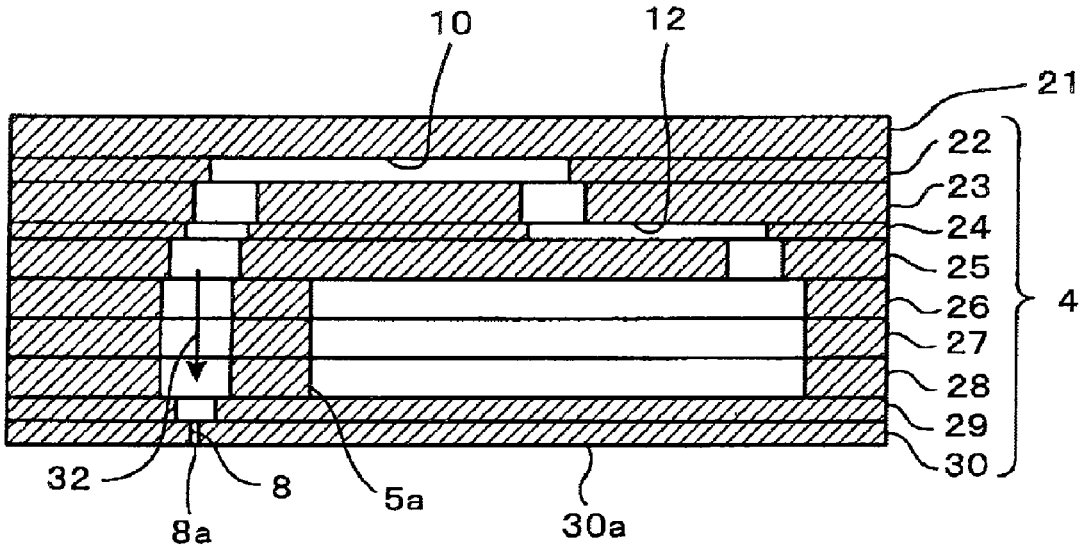
FIG. 7 is a sectional view taken along a line VI-VI in FIG. 6.

FIG. 7 is a sectional view taken along a line VI-VI in FIG. 6. Each of the plates 22 to 29 constituting the passage unit 4 is formed with through-holes, respectively. Through the through-holes, the manifold passages 5, the sub-manifold passages 5*a* and individual ink passages 32 from outlets of the sub-manifold passages 5*a* to the nozzles 8 are formed. The nozzle plate 30, which is the lowest layer of the passage unit 4, is formed with the nozzles 8. On the lower surface of the nozzle plate 30, it is formed ink ejection ports 8*a* that are the openings of the nozzles 8. In other words, the lower surface of the nozzle plate 30 constitutes the ink ejection face 30*a*.

Figure 8:
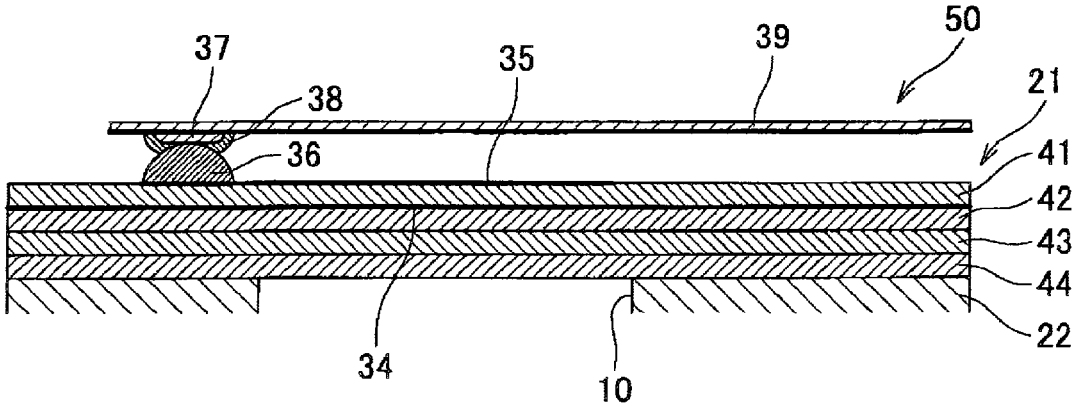
FIG. 8 is an enlarged view including a COF adjacent to a piezoelectric actuator in FIG. 7.

FIG. 8 is an enlarged view of the piezoelectric actuator 21 in FIG. 7. In FIG. 8, the COF 50 is depicted together with the piezoelectric actuator 21. Each of the piezoelectric actuators 21 has a laminated structure in which four piezoelectric layers 41, 42, 43, 44 are piled up on another. The piezoelectric layers 41 to 44 are composed of ferroelectric Piezoelectric Zicronate Titanate (PZT) based ceramics. On the uppermost piezoelectric layer 41, a number of individual electrodes 35 are formed. Each of the individual electrodes 35 corresponds to the single pressure chamber 9. One ends of the respective individual electrodes 35 are formed with lands 36. A common electrode 34 is interposed between the piezoelectric layer 41 and the piezoelectric layer 42. In the mean time, the COF 50 is disposed on the upper surface of the piezoelectric actuator 21. On the lower surface of the COF 50, a number of bumps 37 are disposed correspondingly to the individual electrodes 35. The lower surfaces of the bumps 37 are covered with soldering 38. Through the soldering 38, the lands 36 and the bumps 37 are electrically connected. A driving signal supplied from the COF 50 is transmitted to the individual electrodes 35 through the bumps 37, the soldering 38 and the lands 36. Thereby, the piezoelectric layer 41 is deformed and the pressure is applied to the ink in the pressure chambers 9 from the piezoelectric actuators 21, so that the ink is ejected from the nozzles 8.

When the ink-jet head 2 is attached to a printer and the like and a printing operation is conducted, the ink is filled in the respective ink passages of the passage unit 4 and the reservoir unit 90. In the mean time, as shown in FIG. 1, when the ink-jet head 2 is attached to the ink-jet head protection unit 3, the preservation solution including metal rust inhibitor, dryness inhibitor and surfactant is filled in the ink passages, instead of the ink. Since the metal rust inhibitor is included in the preservation solution filled in the ink passages, it is possible to prevent the metal member constituting the ink passages of the ink-jet head 2 from being rusted. In addition, since the dryness inhibitor is included in the preservation solution, the preservation solution is not evaporated well and it is possible to sustain the protection state of the ink passages of the ink-jet head 2 against the intrusion of the air or foreign substances. Further, since the dryness inhibitor and the surfactant are included in the preservation solution, the surface tension of the preservation solution becomes small, so that air bubbles are not generated well when filling the preservation solution in the ink passages of the ink-jet head. In this embodiment, the preservation solution is constituted by the ink composition except color materials.

FIG. 9 is a side view of the valve 100. In FIG. 9, passages 111, 112, an insertion passage 113 and parts of a valve top 102, which should be depicted by broken lines, are depicted by solid lines and a passage 121 formed in the valve top 102 is depicted by a broken line.

As shown in FIG. 9, the valve 100 comprises a valve main body 101 and a valve top 102. In the valve main body 101, a passage 111 and an insertion passage 113 are formed. A passage 112 and the insertion passage 113 have an opening 112*a* (second ink supply port) and an opening 113*a* at upper parts of the valve main body 101, respectively. The passage 111 is provided with an opening 111*a* (first ink supply port) at a lower part of the valve main body 101. The passage 111 is connected to the ink supply part 96*a* of the upper reservoir 91 through the opening 111*a*. A passage 115 is further formed in the valve main body 101. The passages 111, 112 and the insertion passage 113 communicate with each other through the passage 115. On a side wall of the valve main body 101, two sets of grooves 114, 116 running through the outside of the valve main body 101 from the insertion passage 113 are formed. The two sets of the grooves 114, 116 are symmetrically disposed about a central axis of the insertion passage 113. The grooves 116 extend downward from a vicinity of an upper end of the valve main body 101. In addition, the grooves 114 communicate with lower ends of the grooves 116 and extend along a periphery direction of the valve main body 101 from the lower ends of the grooves 116. Meanwhile, in FIG. 9, only one of the two grooves 114 is depicted. The grooves 114, 116 are engaged with protrusions 125 protruding from the valve top 102, which will be described later.

The valve top 102 is disposed in the insertion passage 113 and extends in the insertion passage 113 in a vertical direction of FIG. 9. A passage 121 is formed in the valve top 102. The passage 121 has an opening 121*a* (third ink supply port) at the upper end of the valve top 102. In addition, it has openings 121*b* at side faces of the valve top 102. The passage 121 extends downward from the opening 121*a* and is bent at a right angle at the lower end thereof to reach the openings 121*b*. In this embodiment, the bent part of right angle is formed by a through-hole intersecting the central axis of the valve top 102. In addition, the two openings 121*b* are symmetrically formed about the central axis of the valve top 102. Like this, the passage 121 generally forms a T-shape in the valve top 102. In addition, a seal member 123 composed of rubber material and the like is attached to a part below the openings 121*b* of the valve top 102. A pulling-out prevention part 124 is formed at a leading end of the valve top 102, so that it is possible to prevent the seal member 123 from being pulled-out from the valve top 102.

In addition, two protrusions 125 are formed about at center part of the valve top 102. The two protrusions 125 are symmetrically disposed about the central axis of the valve top 102 and protrude in a direction intersecting the side faces of the valve top 102. As described above, the protrusions 125 are engaged with the grooves 114, 116. As the protrusions 125 move along the grooves 114, 116, the valve top 102 rotates along the periphery direction of the valve main body 101 and moves in the vertical direction of FIG. 9. In addition, the valve top 102 is provided with a knob 126. The knob 126 is disposed above the opening 113*a*. When the protrusions 125 are disposed in the grooves 114, the valve top 102 can be rotated by turning the knob 126. In addition, when the protrusions 125 are disposed in the grooves 116, the vale top 102 can be vertically moved by moving the knob 126 vertically.

Figure 9B:
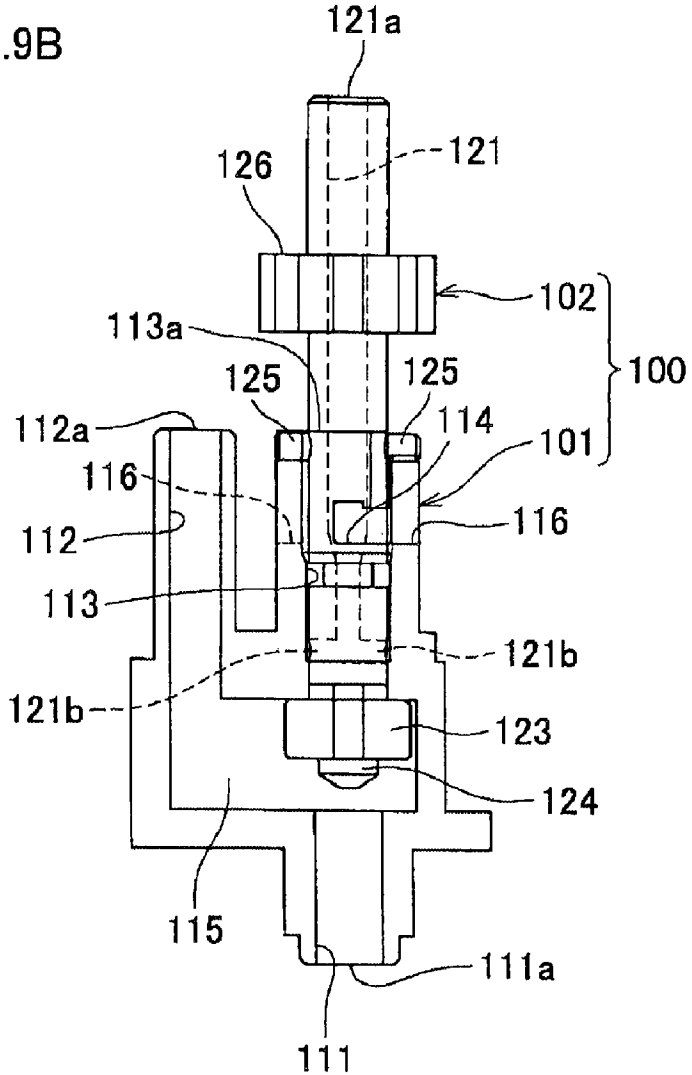
FIG. 9 is a side view of a valve in FIG. 1.
Figure 9A:
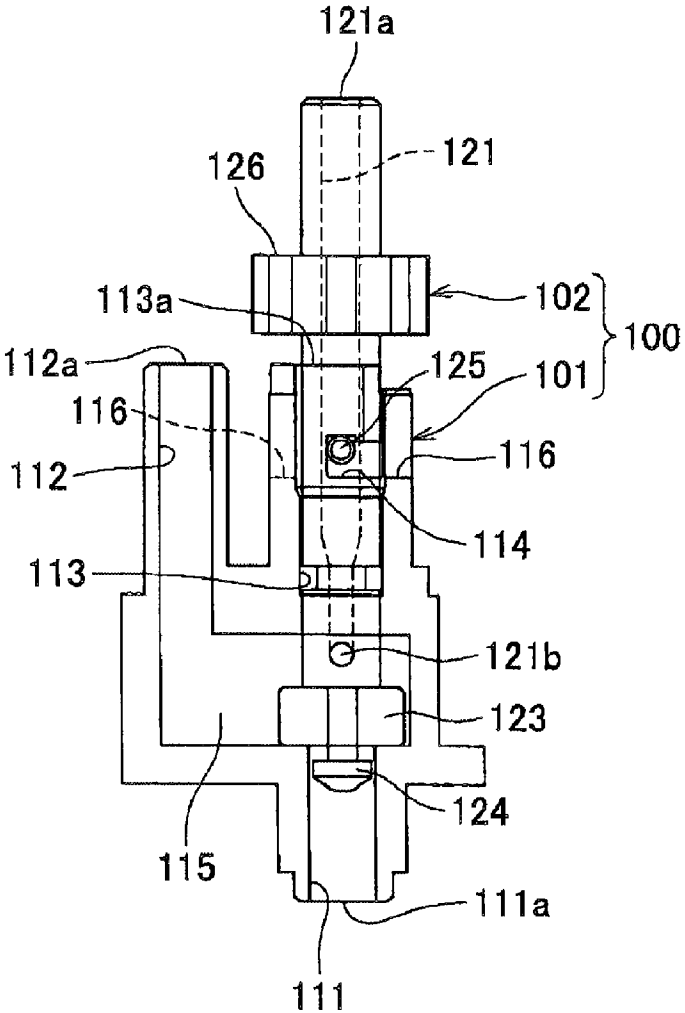

In the followings, an operation of the valve 100 is described. As shown in FIG. 9A, when the protrusions 125 are located in the grooves 114, the opening 121*b* communicates with the passage 115. At this time, the seal member 123 blocks the upper end of the passage 111. In other words, the passage 115 communicates with the passage 112 and the passage 121 and does not communicate with the passage 111.

Under such state, when the knob 126 is rotated, the protrusions 125 can be located in the grooves 116. Then, when the valve top 102 is lifted upward, the valve top 102 is moved upward. Thereby, as shown in FIG. 9B, since the lower end of the insertion passage 113 is blocked by the seal member 123 and the opening 121*b* is blocked by the inner wall face of the insertion passage 113, the passage 115 and the passage 121 does not communicate with each other. In the mean time, since the seal member 123 opens the upper end of the passage 111, the passage 115 and the passage 111 communicate with each other.

Like this, the valve 100 can take the state (communication state) in which the opening 112*a* of the passage 112 communicates with the opening 111*a* of the passage 111 and does not communicate with the opening 121*a* of the passage 121 and the state (sealed state) in which the opening 112*a* of the passage 112 communicates with the opening 121*a* of the passage 121 and does not communicate with the opening 111*a* of the passage 111.

Figure 10:
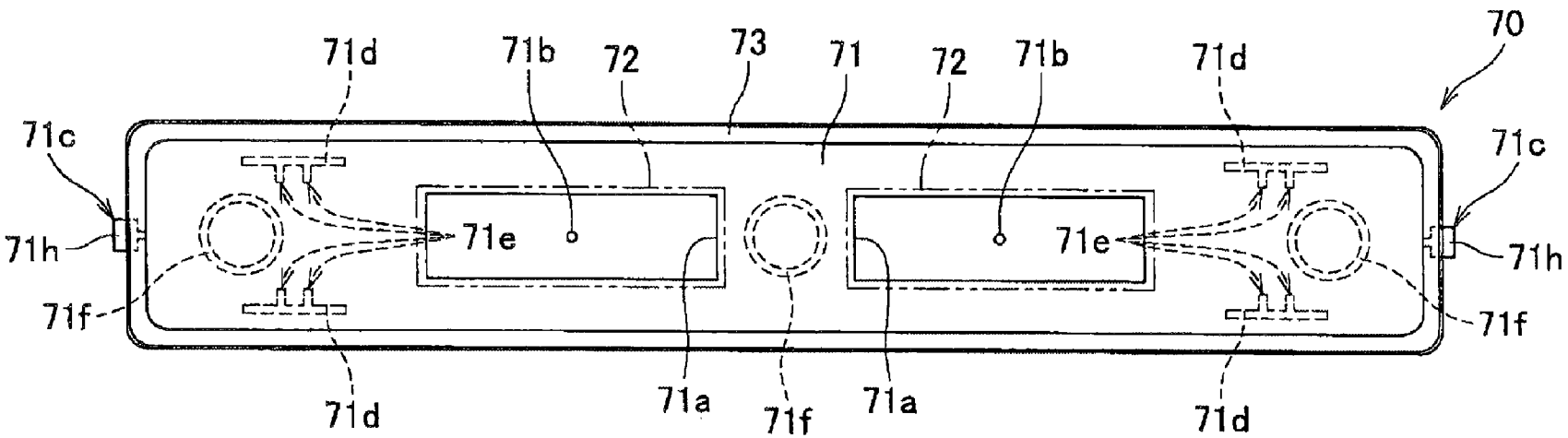
FIG. 10 is a plan view of a head cap in FIG. 1.
Figure 11:
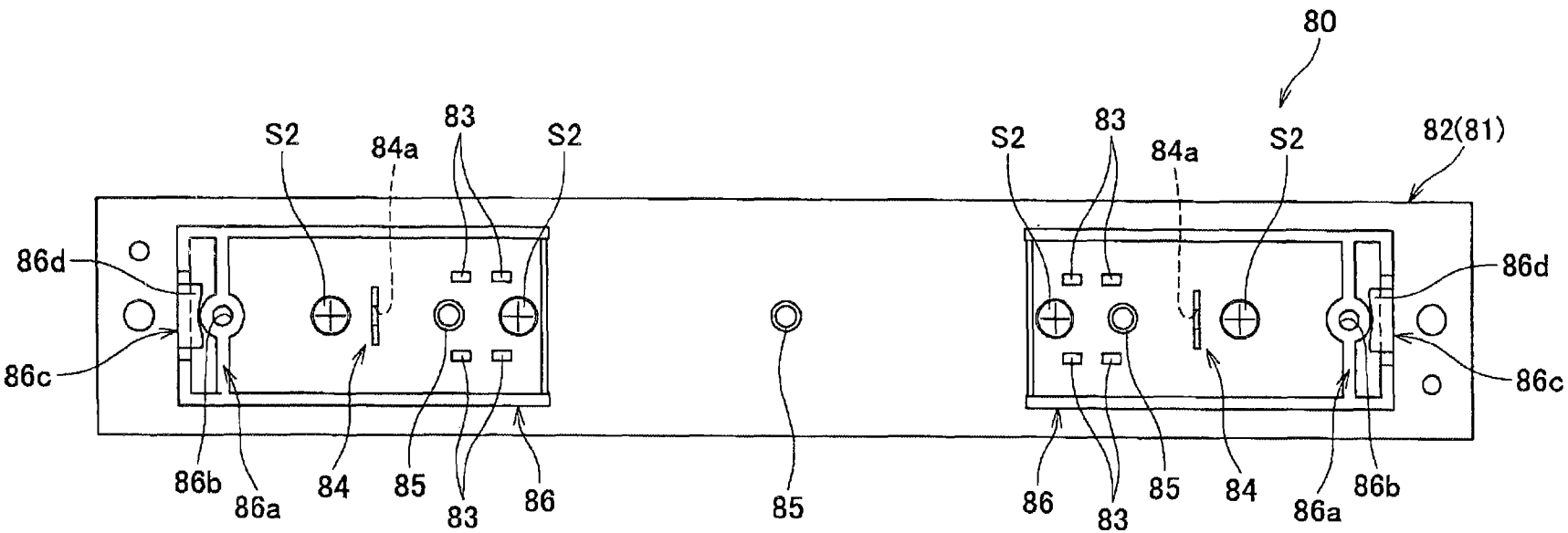
FIG. 11 is a plan view of a support member in FIG. 1.
Figure 12:
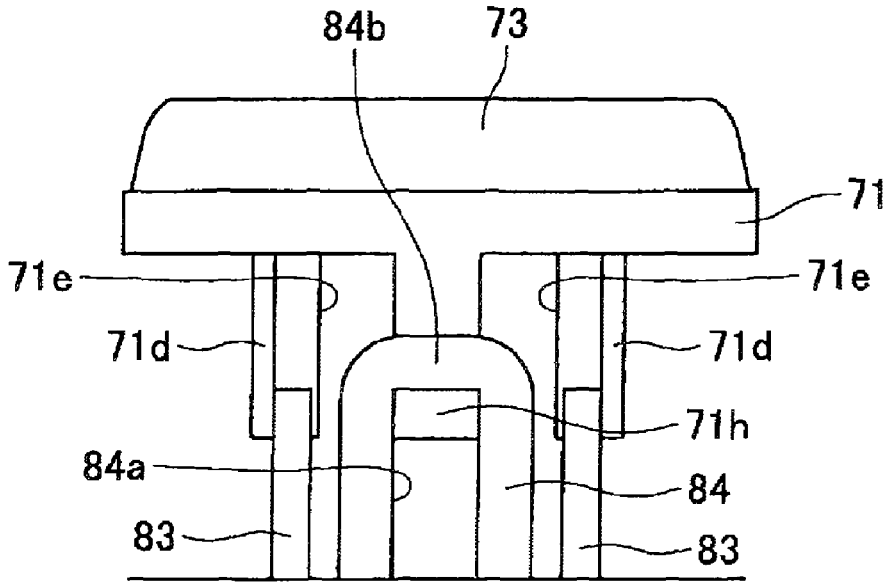
FIG. 12 is a side view of a head cap and a support member viewed from a direction of an arrow XII in FIG. 1.

In the followings, the ink-jet head protection unit 3 is described with reference to FIGS. 1 and 10 to 12. FIG. 10 is a plan view of the head cap 70 shown in FIG. 1. FIG. 11 is a plan view of a support member 80 shown in FIG. 1. FIG. 12 is a side view, viewed from a direction of an arrow XII in FIG. 1. As shown in FIG. 1, the ink-jet head protection unit 3 comprises the head cap 70 and the support member 80.

As shown in FIG. 1, the head cap 70 is sandwiched between the passage unit 4 and the support member 80, and has a plate member 71, two damper films 72 and a lip 73, as shown in FIGS. 1 and 10. The plate member 71 is a flat plate having a substantially rectangular shape in plan view. An upper surface (confronting surface) of the plate member 71 confronts the area in which a number of ink ejection ports 8*a* of the ink ejection face 30*a* are formed, while the ink-jet head 2 being attached to the ink-jet head protection unit 3. On the upper surface of the plate member 71, two recesses 71*a* each having a substantially rectangular shape in plan view are formed at positions symmetrical to the longitudinal and lateral direction of the plate member. The bottom surfaces of the recesses 71*a* are formed with communication-holes 71*b* passing through the plate member 71. In the invention, the recesses 71*a* and the communication-holes 71*b* constitute the through-holes wherein the openings on the upper surface of the plate member 71, i.e., the openings of the recesses 71*a* are larger than the openings on the lower surface of the plate member 71, i.e., the openings of the communication-holes 71*b*.

The two damper films 72 are loosely attached to the upper surface of the plate member 71 so as to cover each of the recesses 71*a*. The adhesion parts between the damper films 72 and the plate member 71 surround the recesses 71*a* over the entire periphery thereof. Thereby, the insides of the recesses 71*a* communicate with the outside air through only the communication-holes 71*b*.

The lip 73 is arranged on the upper surface of the plate member 71 over the entire periphery of the plate member 71 along the outer edges thereof so that it surrounds the two recesses 71*a* and the two communication-holes 71*b* in plan view. The lip 73 is formed to be highest about at the center of the plate member 71, with respect to the direction intersecting the plate member 71. The surface at the highest part (i.e., contact surface) contacts the ink ejection face 30*a*, so that a closed space (inside of the head cap 70) defined by the upper surface of the plate member 71, the lip 73 and the ink ejection face 30*a* is isolated from the outside. In other words, the ink ejection face 30*a* is capped by the head cap 70. Thereby, the ink ejection face 30*a* is protected. In the mean time, the head cap 70 is filled with the air (gas). In addition, as described above, since an outward profile of the lip 74 in plan view is involved in the outward profile of the reinforcement cover 57, the passage unit 4 is reinforced by the reinforcement cover 57 and the passage unit 4 and the reservoir unit 90 are prevented from being deformed due to the pressing force of the lip 73 applied to the ink ejection face 30*a*.

On the lower surface of the plate member 71, it is formed four ribs 71*d* protruding downward, two support member attaching elements 71*c* and three spring attaching elements 71*f*. In plan view, the four ribs 71*d* are symmetrically formed at four corners of the plate member 71, with regard to the longitudinal and lateral directions of the plate member 71. Each of the ribs extends in the longitudinal direction of the plate member 71. Each of the ribs 71*d* is provided, about at a center of the longitudinal direction thereof, with two protrusions 71*e* that protrude inward with regard to the lateral direction of the plate member 71. One side faces of the respective protrusions 71*e* (side faces opposite to the neighboring protrusions 71*e*) extend vertically in FIG. 1 and confront and contact one side faces of protrusions 83 of a support member 80, which will be described later. The one side faces of the protrusions 71*e* are moved along the one side faces of the protrusions 83, so that the head cap 70 can be moved relatively to the support member 80 in the vertical direction of FIG. 12.

The two support member attaching elements 71*c* extend downward, from parts including center portions of both longitudinal ends of the plate member 71 in plan view. At lower ends of the support member attaching elements 71*c*, it is formed protrusions 71*h* that protrude beyond the plate member 71 with respect to the longitudinal direction of the plate member. The protrusions 71*h* are engaged with grooves 84*a* of cap attaching elements 84 of the support member 80, which will be described later. The protrusions 71*h* are moved along the grooves 84*a*, so that the head cap 70 can be moved relatively to the support member 80 in the vertical direction of FIG. 12.

Each of the three spring attaching elements 71*f* has a substantially cylindrical shape and extends downward. They are disposed about at centers of the plate member 71, with respect to the lateral direction thereof. One of them is disposed at a center of the plate member 71*a* with respect to the longitudinal direction thereof. The other two elements are disposed at symmetrical positions with respect to the longitudinal direction of the plate member 71, which positions are adjacent to both of the longitudinal ends of the plate member 71. To the spring attaching elements 71*f* are attached upper ends of springs (press members) 75 which will be described later.

As shown in FIG. 1, the support member 80 is disposed to interpose the head cap 70 between the passage unit 4 and it. The support member 80 has a laminated structure in which a frame member 82 is stacked on a base 81. In addition, the base 81 and the frame member 82 are fixed to each other by four screws S2. As shown in FIGS. 1, 11 and 12, the frame member 82 is provided with eight protrusions 83, two cap attaching elements 84, three spring attaching elements 85 and two frame elements 86.

In plan view, the eight protrusions 83 are formed to interpose the two protrusions 71*e* formed at each of the ribs 71*d* of the head cap 70. The one side faces of the protrusions 71*e* and the one side faces of the protrusions 83 (side faces confronting the one side faces of the protrusions 71*e*) confront and contact each other, so that a position between the head cap 70 and the support member 80 is determined. In addition, the side faces of the ribs 71*d* are moved along the side faces of the protrusions 83, so that the head cap 70 can be moved relatively to the support member 80 in the vertical direction of FIG. 12.

In plan view, the twp cap attaching elements 84 are respectively formed at positions confronting the support member attaching elements 71*c*. Each of the cap attaching elements 84 is formed about at a lateral center of the base 81 with a groove 84*a* that vertically extends in FIG. 12. Each of the cap attaching elements 84 is formed at the top end with a pulling-out prevention part 84*b* that extends in the lateral direction of the base 81. A lower end of the pulling-out prevention part 84*b* constitutes an upper end of the groove 84*a*. The protrusions 71*h* are moved along the grooves 84*a* while being inserted into the grooves 84*a*, so that the head cap 70 can be moved relatively to the support member 80 in the vertical direction of FIG. 12. In addition, the upper ends of the protrusions 71*h* contact the lower ends of the pulling-out prevention parts 84*b*, so that the head cap 70 is prevented from being further moved in the upward direction of FIG. 12. Thereby, the head cap 70 is prevented from being pulled-out from the support member 80. In other words, the head cap 70 can be moved in the downward direction of FIG. 12 until the lower ends of the protrusions 71*h* contact to the upper surface of the plate member 71 and can be moved in the upward direction of FIG. 12 until the upper ends of the protrusions 71*h* contact the lower ends of the pulling-out prevention parts 84*b*.

The three spring attaching elements 85 are formed at positions corresponding to the three spring attaching elements 71*f*, in plan view. To the spring attaching elements 85 are attached lower ends of springs 75 which will be described later.

The two frame elements 86 are formed such that they are symmetrical with respect to the longitudinal and lateral directions of the frame member 82. The one frame element 86 surrounds a single set of the protrusions 83, the cap attaching element 84 and the spring attaching element 85 formed on the upper half part of the frame member 82, in FIG. 12. The other frame element 86 surrounds a single set of the protrusions 83, the cap attaching element 84 and the spring attaching element 85 formed on the lower half part of the frame member 82, in FIG. 12. In addition, the respective frame elements 86 are formed such that they are higher than the other parts near both of the longitudinal ends of the frame member 82.

Support elements 86*a* are formed near both of the longitudinal ends of the frame member 82. The support elements 86*a* extend along the lateral direction of the frame member 82. Each of the support elements 86*a* is formed about at the lateral center of the frame member 82 with a hole 86*b* having a substantially circular shape to which a screw S1 is attached, which will be described later. The respective frame elements 86 are formed with fixing elements 86*c* at outer positions than the support elements 86*a*, with respect to the longitudinal direction of the frame member 82. As shown in FIG. 1, the fixing elements 86*c* extend upward from the upper surface of the frame member 82. The respective fixing elements 86*c* are formed with claws 86*d* at lower positions than upper ends thereof, which inwardly protrude with respect to the longitudinal direction of the frame member 82. A distance between the upper surface of the support element 86*a* and the lower surface of the claw 86*d* is approximately same as a thickness of the reservoir base plate 92. Both of the longitudinal ends of the reservoir base plate 92 are fitted by the support elements 86*a* and the claws 86*d*, so that the ink-jet head 2 is fixed to the ink-jet head protection unit 3. Further, under such state, the reservoir base plate 92 and the support elements 86*b* are fixed by the screws S1, so that the ink-jet head 2 is securely fixed to the ink-jet head protection unit 3.

The three spring 75 are interposed between the head cap 70 and the support member 80. As described above, both ends of the springs 75 are respectively attached to the spring attaching elements 71*f* of the head cap 70 and the spring attaching elements 83 of the support member 80. The support member 80 presses the head cap 70 toward the ink ejection face 30*a* through the springs 75 (i.e., toward the upward direction in FIG. 1). In other words, the springs 75 bias the head cap 70. Thereby, the support member 80 can efficiently press the head cap 70 through the springs 75. In addition, since the springs 75 always press the head cap 70 in the upward direction in FIG. 1, the head cap 70 is stabilized with respect to the vertical movement in FIG. 12. In the mean time, as described above, since the passage unit 4 is reinforced by the reinforcement cover 57 consisting of the side covers 53 and the head cover 55 and the outward profile of the reinforcement cover 57 involves the outward profile of the lip 73, the passage unit 4 and the reservoir unit 90 are prevented from being deformed due to the pressing force of the head cap 70 applied to the ink ejection face 30*a*. Furthermore, in this embodiment, as described above, the side covers 53 and the head cover 55 cooperatively prevent the ink-jet head 2 from being deformed. However, only the cover members such as side covers 53 may be provided which intersect the upper surface of the passage unit 4 and extend in the longitudinal direction of the passage unit 4.

In the followings, it is described that the ink-jet head protection assembly 1 is formed by the ink-jet head 2 and the ink-jet head protection unit 3, and a method of protecting the ink-jet head 2.

When it is desired to form the ink-jet head protection assembly 1, the valve 100 is first attached to the upper reservoir 91 so that the ink supply part 96*a* (refer to FIG. 5), which is provided to the upper reservoir 91 of the ink-jet head 2, and the passage 111 (refer to FIG. 9) of the valve main body 101 are connected to each other (valve attaching step).

Next, the valve 100 is sealed as shown in FIG. 9A. In other words, the valve top 102 is moved downward, the upper part of the passage 111 is blocked by the seal member 123 and the openings 121*b* are made to communicate with the passage 115. Then, the preservation solution including metal rust inhibitor, dryness inhibitor and surfactant is introduced from the opening 112*a* of the passage 112 (liquid introducing step). Thereby, the preservation solution introduced from the opening 112 flows out from the opening 121*a* through the passages 112, 115, 121. At this time, in addition to the preservation solution, the air or foreign substances present in the passages 112, 115 also flow out from the opening 121*a*, so that the air or foreign substances are not present in the passages 112, 115.

Next, the valve 100 is made under communication state as shown in FIG. 9B. In other words, the valve top 102 is upward moved, so that the passage 121 of the valve top 102 and the passage 115 of the head main body 101 do not communicate each other and the passage 111 and the passage 115 of the head main body 101 communicate each other (opening step). Then, the introduced preservation solution is introduced in the ink passages formed in the reservoir unit 90 and the passage unit 4 through the passage 111. Then, when the preservation solution is introduced to the ink ejection ports 8*a*, the preservation solution is filled in the ink passages of the ink-jet head 2 (filling step).

Next, the ink-jet head 2 is disposed to the ink-jet head protection unit 3 so that both ends of the reservoir base plate 92 are fitted between the support elements 86*a* and the claws 86*d*. Then, the ink-jet head and the ink-jet head protection unit are fixed by the screws S1, so that the ink-jet head 2 is attached to the ink-jet head protection unit 3 (cap attaching step). Thereby, the lip 73 of the head cap 70 contacts the ink ejection face 30*a* so that it surrounds all the ink ejection ports 8*a*.

Next, the valve 100 is sealed as shown in FIG. 9A. In other words, the valve top 102 is moved downward and the upper part of the passage 111 is blocked by the seal member 123 (valve sealing step). As a result, the ink-jet head protection assembly 1 shown in FIG. 1 is formed and the ink-jet head 2 is protected.

Figure 13A:
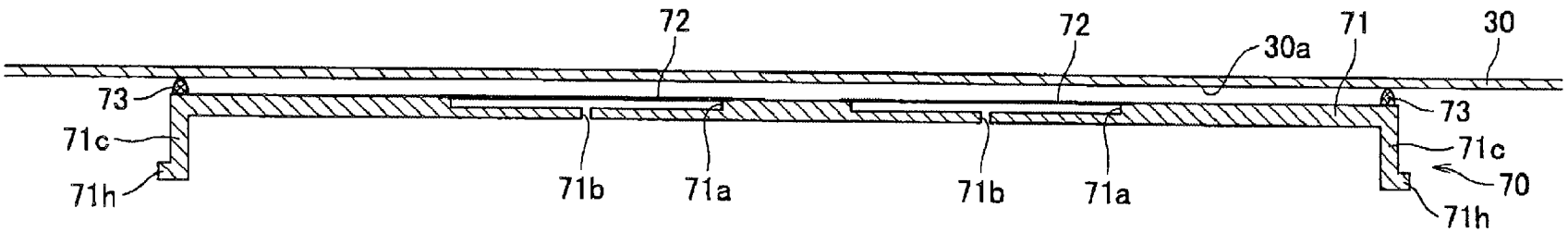
FIG. 13A to FIG. 13C show states when air pressure is changed in a cap while an ink ejection face being covered by a head cap.
Figure 13B:
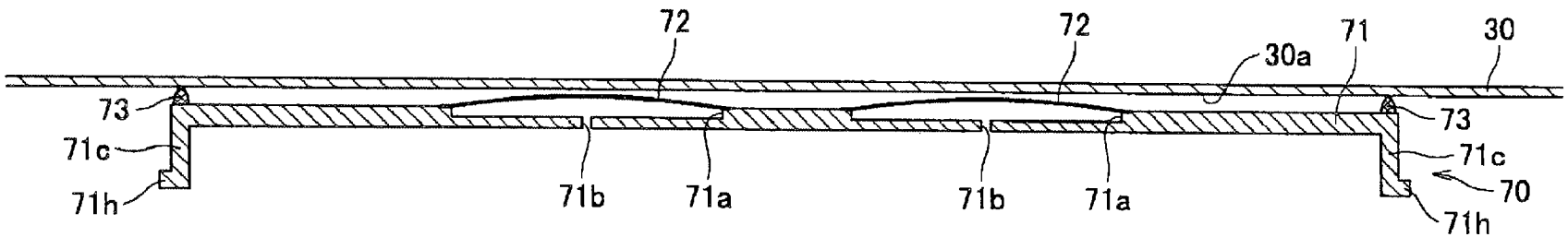
Figure 13C:
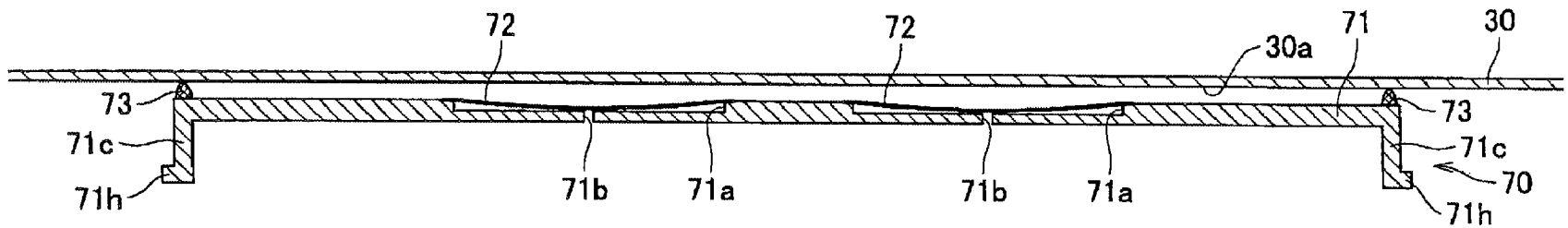

In the ink-jet head protection assembly 1, it is described an operation of the head cap 70 when air pressure is changed while the ink ejection face 30*a* being capped by the head cap 70, with reference to FIGS. 13A to 13C. FIGS. 13A to 13C show states of the head cap 70 when air pressure is changed while the ink ejection face 30*a* being capped by the head cap 70.

As shown in FIG. 13A, the ink ejection face 30*a* is capped by the head cap 70. Herein, when air pressure in the head cap 70 is lowered due to the temperature drop at the surrounding of the head cap 70, for example, the air pressure in the head cap 70 becomes lower than the atmosphere. In other words, the air pressure is lowered below the air pressures in the recesses 71*a* that communicate with the outside of the head cap 70 through the communication-holes 71*b*. Accordingly, as shown in FIG. 13B, the damper films 72 are swollen toward the ink ejection face 30*a*. Since the capacity in the head cap 70 is reduced due to the deformation of the damper films 72, the air pressure in the head cap 70 rises to be approximately same as the atmosphere.

In the mean time, under state shown in FIG. 13A, when the air pressure in the head cap 70 rises due to the rise in temperature at the surrounding of the head cap 70, for example, the air pressure in the head cap 70 becomes higher than the air pressures in the recesses 71*a*. Accordingly, as shown in FIG. 13C, the damper films 72 go down into the recesses 71*a*. Since the capacity in the head cap 70 is increased due to the deformation of the damper films 72, the air pressure in the head cap 70 is lowered. At this time, since the damper films 72 are adhered to the upper surface of the plate member 71 so that they cover the recesses 71*a*, the damper films can be deformed until the films contact the bottom surfaces of the recesses 71*a*.

Through the above operation, the change in the pressure of the head cap 70 is absorbed. Thereby, it is difficult for the preservation solution in the ink passages of the ink-jet head 2 to flow out or for the air or foreign substances to enter the ink passages from the nozzles 8. Herein, since the damper films 72 are loosely attached, they can be highly deformed. The looseness of the damper films 72 is adjusted such a level that when the damper films are deformed to the highest degree in the upward direction, they do not contact the ink ejection face 30*a*.

According to the embodiment as described above, since the ink ejection face 30*a* is covered by the head cap 70, there occurs no situation where the adhesive remains on the ink ejection face 30*a* and the nozzles 8 are blocked by the adhesive, as a case where the ink ejection face 30*a* is protected by the adhesive tape. Accordingly, when using the ink-jet head, it is possible to protect the ink ejection face 30*a* while preventing the bad ejection problem of the ink drops.

In addition, the plate member 71 constituting the head cap 70 is formed with the recesses 71*a* and the communication-holes 71*b*, and the recesses 71*a* are covered by the damper films 72. When the air pressure in the head cap 70 is lowered below the atmosphere, the damper films 72 are swollen toward the ink ejection face 30*a* and when the air pressure in the head cap 70 is higher than the atmosphere, the damper films 72 go down into the recesses 71*a*. Thereby, it is possible to absorb the change in pressures of the head cap 70. Accordingly, it is difficult for the preservation solution filled in the ink passages of the ink-jet head 2 to flow out or for the air or foreign substances to enter the ink passages from the nozzles 8.

In addition, the through-holes formed in the head cap 70 consist of the recesses 71*a* and the communication-holes 71*b*. Thereby, the through-holes are structured in such a manner that the one opening contacting the damper films 72 of the two openings of the through-holes in the one surface and the other surface of the plate member 71 is larger than the other opening. Accordingly, the damper films 72 can be easily deformed and the change in air pressure can be absorbed more effectively.

Additionally, since the head cap 70 is pressed toward the ink ejection face 30*a* by the springs 75, the lip 73 securely contacts the ink ejection face 30*a*. Thereby, the air-tightness in the head cap 70 is improved and the ink ejection face 30*a* is protected more securely. In the mean time, on the surface of the plate member 71 at the support member 80, the four ribs 71*d* are formed. The ribs are formed at four corners of the plate member 71, thereby contributing to the local rigidity improvement. However, the ribs do not contribute to the entire rigidity improvement. As such, the head cap 70 has a flexibility capable of easily following the ink ejection face 30*a* and contributes to the improvement of the close adhesion when the lip 73 contacts.

Further, since the reservoir base plate 92 is fixed to the support member 86 by the screws S1 to fix the passage unit 4 to the support member 86, it is possible to protect the ink ejection face 30*a* with the head cap 70 more securely.

In addition, when putting the preservation solution in the ink passages, the preservation solution flows into the passage 115 and the passage 121 while the valve 100 being sealed, so that the air bubbles or foreign substances in the passages of the valve 100 are discharged from the opening 121*a*. Then, after the valve 100 is made under communication state, the preservation solution is filled in the ink passages of the ink-jet head 2. Accordingly, when filling the preservation solution, it is possible to prevent the air or foreign substances from getting mixed with the preservation solution in the ink passages of the ink-jet head 2. Thereby, just by replacing the preservation solution with the ink, the ink-jet head 2 can be used for printing.

Further, since the valve 100 is sealed after filling the preservation solution, it is possible to prevent the air or foreign substances from entering the ink passages through the valve 100.

In addition, since the preservation solution includes the metal rust inhibitor, it is possible to prevent the metal member constituting the ink passages of the ink-jet head 2 from being rusted. Furthermore, since the preservation solution includes the dryness inhibitor, the preservation solution is not evaporated well and it is possible to sustain the protection state of the ink passages of the ink-jet head 2 against the intrusion of the air or foreign substances. Additionally, since the preservation solution includes the dryness inhibitor and the surfactant, the surface tension of the preservation solution becomes small, so that the air bubbles are not produced well when filling the preservation solution in the ink passages of the ink-jet head 2.

In addition, since the side covers 53 are upright mounted on the surface opposite to the ink ejection face 30*a* of the passage unit 4 and the outward profile of the reinforcement cover consisting of the side covers 53 and the head cover 55 is involved in the outward profile of the ink-jet head 2 while involving the outward profile of the lip 73, it is possible to prevent the passage unit 4 and the reservoir unit 90 from being deformed due to the pressing force of the head cap 70 applied to the ink ejection face 30*a*. Further, it is possible to prevent the ink-jet head 2 from being damaged due to unnecessary external force during the transport.

Hereinafter, description will be made to modifications of the present embodiment. In the modifications, the same members as in the above embodiment will be devoted by the same reference numerals, and the detailed description thereof will be properly omitted.

Figure 14:
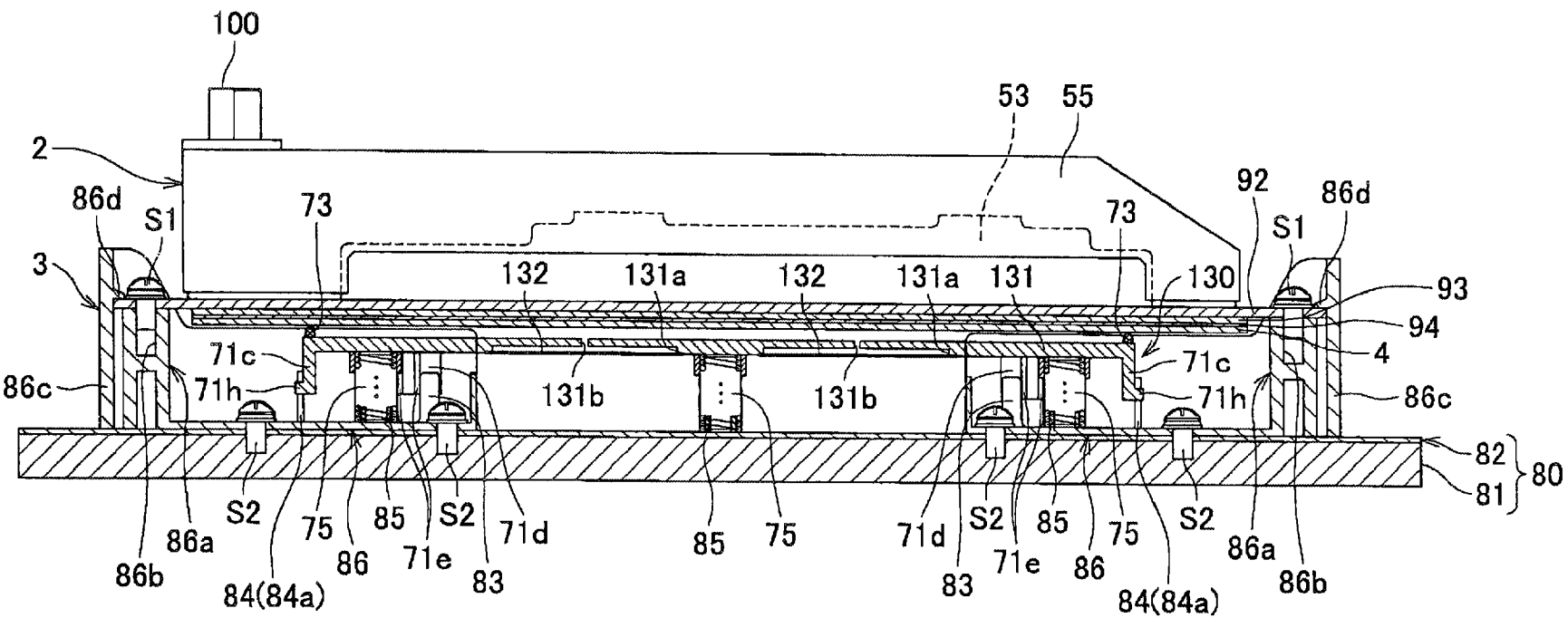
FIG. 14 shows a first modification corresponding to FIG. 1.

In one modification, as shown in FIG. 14, on a lower surface of a plate member 131 of a head cap 130, two recesses 131*a* are formed. Communication-holes 131*b* are formed at portions corresponding to centers of the respective recesses 131*a*, viewed from the upper surface of the plate member 131. Damper films 132 are adhered to the lower surface of the plate member 131 so that the films cover the openings of the respective recesses 131*a*. In this case, when the air pressure in the head cap 130 is lowered below the atmosphere, the damper films 132 go down into the recesses 131*a* and when the air pressure in the head cap 130 is increased above the atmosphere, the damper films 132 are swollen away from the ink ejection face 30*a*. Thereby, the change in pressure of the head cap 130 is absorbed. In addition, also in this case, the recesses 131*a* and the communication-holes 131*a* constitute the through-holes of the present invention. Regarding the through-holes, the openings at the adhesion side of the damper films 132 are ones of the recesses 131*a* and are larger than the openings of the communication-holes 131*b*, which are the other openings. Accordingly, the damper films 132 can be easily deformed in such a manner that they go down into the recesses 131*a*. In addition, even though the looseness of the damper films 132 is not particularly adjusted, since the damper films 132 do not contact the ink ejection face 30*a*, the ink ejection face 30*a* is not polluted or damaged.

In the above embodiment, the ink-jet head 2 is fixed to the ink-jet head protection unit 3 by the screws S1. However, the fixation by the screws S1 may be unnecessary. Also in this case, since the reservoir base plate 82 is sandwiched by the support elements 86*a* and the claws 86*d* of the support member 80, thereby fixing the ink-jet head 2 to the ink-jet head protection unit 3, it is possible to make the lip 73 contact the ink ejection face 30*a* securely.

In the above embodiment, the preservation solution includes the metal rust inhibitor, the dryness inhibitor and the surfactant. However, the preservation solution may include one or two of them, instead of including all of them. In this case, when the metal rust inhibitor is included, it is possible to prevent the metal member constituting the ink passages of the ink-jet head 2 from being rusted. When the dryness inhibitor is included, the preservation solution is not evaporated well and it is possible to sustain the protection state of the ink passages of the ink-jet head 2 against the intrusion of the air or foreign substances. Additionally, when the surfactant is included, the surface tension of the preservation solution becomes small, so that the air bubbles are not produced well when filling the preservation solution in the ink passages of the ink-jet head 2.

In the above embodiment, during the liquid introducing step, the preservation solution is introduced from the opening 112*a* of the passage 112 and is discharged from the opening 121*a* of the passage 112. However, to the contrary, the preservation solution may be introduced from the opening 121*a* and discharged from the opening 112*a*.

Furthermore, in the above embodiment, after filling the preservation solution, the ink-jet head 2 is attached to the ink-jet head protection unit 3 and then the upper part of the passage 111 is blocked by the seal member 123. However, to the contrary, the upper part of the passage 111 may be blocked by the seal member 123 and then the ink-jet head 2 may be attached to the ink-jet head protection unit 3.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head protection assembly comprising:

an ink jet head including a passage unit having an ejection face provided with ejection ports to eject ink and an ink passage formed therein to communicate with the ejection ports;

a head cap having a confronting surface confronting the ejection face and a protrusion protruding toward the ejection face, the confronting surface including, in plan view, an area of the ejection face in which the ejection ports are formed, the protrusion having a contact surface to the ejection face surrounding, in plan view, the area of the ejection face in which the ejection ports are formed; and a support member supporting the head cap so that the contact surface is in contact with the ejection face, wherein gas is filled in a closed space defined by the confronting surface, the protrusion and the ejection face;

the head cap includes a plate member having a through-hole and a film slackly attached to one surface of the plate member and covering the through-hole;

the confronting surface consists of at least a part of the one surface of the plate member and a surface of the film; and the protrusion is formed on the one surface of the plate member so as to cover the through-hole in plan view.

2. The ink jet head protection assembly according to claim 1, wherein an opening of the through-hole on the one surface of the plate member is larger than an opening of the through-hole on another surface of the plate member.

3. The ink-jet head protection assembly according to claim 1, further comprising a bias member, wherein:

the support member is disposed to sandwich the head cap together with the passage unit; and a bias member is disposed between the support member and the head cap, is fixed to the support member and biases the head cap toward the ejection face.

4. An ink-jet head protection assembly comprising:

an ink-jet head including a passage unit having an ejection face provided with ejection ports to eject ink and an ink passage formed therein to communicate with the ejection ports;

a head cap having a confronting surface confronting the ejection face and a protrusion protruding toward the ejection face, the confronting including, in plan view, an area of the ejection face in which the ejection ports are formed, the protrusion having a contact surface to the ejection face surrounding, in plan view, the area of the ejection face in which the ejection ports are formed; and a support member supporting the head cap so that the contact surface is in contact with the ejection face, wherein gas is filled in a closed space defined by the confronting surface, the protrusion and the ejection face;

the head cap includes a plate member having a through-hole and a film attached to one surface of the plate member and covering the through-hole;

the confronting surface consists of at least a part of another surface of the plate member; and the protrusion is formed on the other surface of the plate member so as to covers the through-hole in plan view.

5. An ink-jet head protection assembly comprising:

an ink jet head including a passage unit having an ejection face provided with ejection ports to eject ink and an ink passage formed therein to communicate with the ejection ports;

a head cap having a confronting surface confronting the ejection face and a protrusion protruding toward the ejection face, the confronting surface including, in plan view, an area of the ejection face in which the ejection ports are formed, the protrusion having a contact surface to the ejection face surrounding, in plan view, the area of the ejection face in which the ejection ports are formed; and a support member supporting the head cap so that the contact surface is in contact with the ejection face, wherein gas is filled in a closed space defined by the confronting surface, the protrusion and the ejection face; and the support member is fixed in the passage unit by at least one screw.

6. An ink jet head protection assembly comprising:

an ink-jet head including a passage unit having an ejection face provided with ejection ports to eject ink and an ink passage formed therein to communicate with the ejection ports;

a head cap having a confronting surface confronting the ejection face and a protrusion protruding toward the ejection face, the confronting surface including, in plan view, an area of the ejection face in which the ejection ports are formed, the protrusion having a contact surface to the ejection face surrounding, in plan view, the area of the ejection face in which the ejection ports are formed;

a support member supporting the head cap so that the contact surface is in contact with the ejection face; and a valve having a first ink supply port connected to the ink passage of the passage unit, a second ink supply port different from the first ink supply port and a third ink supply port different from the first and second ink supply ports, wherein the valve selectively takes a state in which the second ink supply port communicates with the first ink supply port and does not communicate with the third ink supply port and a state in which the second ink supply port communicates with the third ink supply port and does not communicate with the first ink supply port, wherein gas is filled in a closed space defined by the confronting surface, the protrusion and the ejection face.

7. The ink jet head protection assembly according to claim 6, wherein:

liquid is filled in the ink passage from the first ink supply port to the ejection ports of the passage unit; and the valve takes the state in which the second ink supply port communicates with the third ink supply port and does not communicate with the first ink supply port.

8. The ink jet head protection assembly according to claim 7, wherein the liquid includes at least one of metal rust inhibitor, dryness inhibitor and surfactant.

9. An ink-jet head protection assembly comprising:

an ink-jet head including a passage unit having an ejection face provided with ejection ports to eject ink and an ink passage formed therein to communicate with the ejection ports;

a head cap having a confronting surface confronting the ejection face and a protrusion protruding toward the ejection face, the confronting surface including, in plan view, an area of the ejection face in which the ejection ports are formed, the protrusion having a contact surface to the ejection face surrounding, in plan view, the area of the ejection face in which the ejection ports are formed; and a support member supporting the head cap so that the contact surface is in contact with the ejection face, wherein gas is filled in a closed space defined by the confronting surface, the protrusion and the ejection face; and the passage unit comprises a plurality of piezoelectric actuators on a surface opposite to the ejection face, which are arranged in a longitudinal direction of the passage unit and are provided to eject ink from the ejection ports in the passages;

a reinforcement cover having a rectangular shape in plan view, surrounding the plurality of the piezoelectric actuators and reinforcing the passage unit, is fixed on the surface opposite to the ejection face of the passage unit; and the outline shape of the reinforcement cover in plan view, is involved in the outline shape of the ink-jet head and involves a contact part of the ejection face and the contact surface.

10. A protection method of an ink jet head including a passage unit having an ejection face provided with ejection ports to eject ink and ink passages formed therein to communicate with the ejection ports, the method comprising:

a valve attaching step of attaching a valve having first, second and third ink supply ports different from one another to the ink jet head so that the first ink supply port is connected to the ink passage of the passage unit, the valve selectively taking a communication state in which the second ink supply port communicates with the first ink supply port and does not communicate with the third ink supply port and a sealed state in which the second ink supply port communicates with the third ink supply port and does not communicate with the first ink supply port;

a liquid introducing step of introducing liquid into one of the second and third ink supply ports of the valve that is attached to the ink-jet head in the valve attaching step and is made to be under sealed state, and discharging the introduced liquid from the other ink supply port of the second and third ink supply ports;

a valve opening step of changing the state of the valve to the communication state from the sealed state after the liquid introducing step;

a filling step of filling the liquid in the ink passage of the ink jet head through the second ink supply port and the first ink supply port of the valve that is made to be under communication state in the valve opening step;

a cap attaching step of attaching a head cap, which is provided with a protrusion which has a contact surface to the ejection face and is formed along an imaginary closed curve in plan view, to the ink-jet head filled with the liquid in the filling step so that the contact surface is in contact with the ejection face and surrounds, in plan view, an area in which the ejection ports are formed; and a valve sealing step of changing the state of the valve to the sealed state from the communication state in the ink-jet head filled with the liquid in the filling step.

* * * * *